US012484688B2

(12) United States Patent
Tserpelis

(10) Patent No.: US 12,484,688 B2
(45) Date of Patent: Dec. 2, 2025

(54) RACK ASSEMBLIES AND METHODS OF USING

(71) Applicant: Eliza Tserpelis, Schererville, IN (US)

(72) Inventor: Eliza Tserpelis, Schererville, IN (US)

( * ) Notice: Subject to any disclaimer, the term of this patent is extended or adjusted under 35 U.S.C. 154(b) by 0 days.

(21) Appl. No.: 18/508,843

(22) Filed: Nov. 14, 2023

(65) Prior Publication Data

US 2024/0156241 A1 May 16, 2024

Related U.S. Application Data

(60) Provisional application No. 63/383,572, filed on Nov. 14, 2022.

(51) Int. Cl.
*A45F 3/44* (2006.01)
*A47G 25/06* (2006.01)

(52) U.S. Cl.
CPC ..... *A45F 3/44* (2013.01); *A47G 25/0664* (2013.01)

(58) Field of Classification Search
CPC ... A45F 3/44; A47G 25/0664; A47G 25/0685; A45B 2023/0012
See application file for complete search history.

(56) References Cited

U.S. PATENT DOCUMENTS 1,366,710 A * 1/1921 Anker ..... F21L 19/00 248/156
1,525,701 A * 2/1925 Rose ..... A47G 25/0664 211/196
2,597,157 A * 5/1952 Martino ..... A47G 25/08 126/30
3,136,510 A * 6/1964 Bowers ..... E04H 13/003 248/156
3,749,253 A * 7/1973 Carter ..... A45F 3/44 211/171
4,865,283 A * 9/1989 Parker ..... A47F 5/04 211/205
5,108,058 A * 4/1992 White ..... A45F 3/44 248/231.71
5,323,991 A * 6/1994 West ..... A01K 97/10 248/513

(Continued)

FOREIGN PATENT DOCUMENTS

DE 202022001103 U1 * 8/2022 ..... A45F 3/44
FR 2574274 A3 * 6/1986 ..... A47G 25/0664

(Continued)

OTHER PUBLICATIONS

Screenshot off Amazon Shopping of Towel Holder (2021), 1 page.

*Primary Examiner* — Taylor Morris
(74) *Attorney, Agent, or Firm* — Hartman Global IP Law; Gary M. Hartman; Domenica N.S. Hartman

(57) ABSTRACT

Rack assemblies and methods of use. Such a rack assembly includes upper and lower subassemblies, the upper subassembly having an upper rod having an upper end and a lower end and at least one prong extending laterally at the upper end of the upper rod. The lower subassembly is removably connectable to the upper subassembly and includes a lower rod having an upper end and a lower end, multiple stabilizing prongs at the lower end of the lower rod, and at least one beam that laterally extends from the lower rod adjacent the lower end thereof and offsets at least one of the stabilizing prongs from an axis of the lower rod.

4 Claims, 7 Drawing Sheets

(56) References Cited

U.S. PATENT DOCUMENTS 5,819,961 A * 10/1998 Harris ..... A47G 25/0671 211/196
5,906,277 A * 5/1999 Vienneau ..... A47G 25/0664 206/287.1
6,490,823 B1 * 12/2002 Ibarra ..... A45F 3/44 248/512
6,612,320 B2 * 9/2003 Lin ..... A45B 25/22 135/33.7
6,675,819 B2 * 1/2004 Arrowood ..... A45F 3/44 248/156
6,702,129 B1 * 3/2004 Harris ..... A47G 25/0664 211/172
D655,531 S * 3/2012 Gharst ..... D3/10
8,191,562 B1 * 6/2012 Sampson ..... A45B 19/04 248/530
9,770,087 B2 * 9/2017 Head ..... A45F 3/44
9,909,250 B1 * 3/2018 Greenspon ..... A47G 25/0685
D840,672 S * 2/2019 Nichols ..... D3/10
10,244,852 B1 * 4/2019 Donaldson ..... A45F 3/10
10,729,226 B1 * 8/2020 Zamora ..... A45F 3/44
11,178,959 B1 * 11/2021 Stockton ..... F16M 11/28
11,737,549 B2 * 8/2023 Cruickshank ..... A45F 3/44 220/8
2007/0084975 A1 * 4/2007 Steiger ..... A47G 7/042 248/27.8
2009/0278020 A1 * 11/2009 Marcil ..... E04H 12/2215 248/545
2015/0083678 A1 * 3/2015 Baughman ..... A47F 5/04 211/85.3
2018/0106062 A1 * 4/2018 Brady ..... A45B 25/00
2019/0246787 A1 * 8/2019 Flores ..... A45F 3/44

FOREIGN PATENT DOCUMENTS

GB 191201962 A * 11/1912 ..... A47G 25/0664
GB 245868 A * 1/1926 ..... A47G 25/0664
GB 2502597 A * 12/2013 ..... A47G 25/0664

* cited by examiner

RACK ASSEMBLIES AND METHODS OF USING

CROSS-REFERENCE TO RELATED APPLICATIONS

This application claims the benefit of U.S. Provisional Application No. 63/383,572 filed Nov. 14, 2022, the contents of which are incorporated herein by reference.

BACKGROUND OF THE INVENTION

The invention generally relates to racks on which items, including but not limited to towels, apparel, and accessories, can be hung. The invention particularly relates to portable rack assemblies from which articles, such as towels, apparel, and various other items, may be hung and optionally dried, and also relates to methods of using the same.

When in an environment that requires the use of towels, it is often desirable to have some method or apparatus by which the towels may be hung to dry. Typically, towels are dried by hanging them on a raised object, such as a peg or bar mounted to a wall, such that as much surface area as possible is exposed to air. However, in an environment such as the beach and other outdoor locations, such means by which to dry a towel may not be readily available.

Therefore, it would be desirable to have a rack assembly suitable for use at beaches and other outdoor locations to elevate and dry towels, apparel, and various other items while being sufficiently compact to be carried and emplaced by an individual.

BRIEF SUMMARY OF THE INVENTION

The intent of this section of the specification is to briefly indicate the nature and substance of the invention, as opposed to an exhaustive statement of all subject matter and aspects of the invention. Therefore, while this section identifies subject matter recited in the claims, additional subject matter and aspects relating to the invention are set forth in other sections of the specification, particularly the detailed description, as well as any drawings.

The present invention provides, but is not limited to, rack assemblies on which towels and various other items can be hung for drying, as well as methods for their use. The rack assemblies are particularly intended to elevate towels (including beach towels) and other items above a ground surface, wherein the term "ground" is used herein to refer to soil including but not limited to sand or other relatively loose materials made up of particles.

According to a nonlimiting aspect of the invention, a rack assembly includes upper and lower subassemblies. The upper subassembly has an upper rod having an upper end and a lower end and at least one prong extending laterally at the upper end of the upper rod. The lower subassembly is removably connectable to the upper subassembly and includes a lower rod having an upper end and a lower end, multiple stabilizing prongs at the lower end of the lower rod, and at least one beam that laterally extends from the lower rod adjacent the lower end thereof and offsets at least one of the stabilizing prongs from an axis of the lower rod. Means is provided for removably connecting the lower end of the upper rod to the upper end of the lower rod to arrange the upper and lower rods coaxial with each other.

According to another nonlimiting aspect of the invention, a method of using a rack assembly as described above includes removably connecting the lower end of the upper rod to the upper end of the lower rod to arrange the upper and lower rods coaxial with each other, using the at least one beam to drive the stabilizing prongs into the ground so that the rack assembly is in an upright position, and placing an article on the at least one prong such that the article is elevated above and off the ground surface.

A rack assembly according to one or more principles of the present disclosure may be constructed of lightweight material and its components connected and arranged to facilitate use, emplacement, and transport.

Other aspects and advantages will be appreciated from the following detailed description.

DETAILED DESCRIPTION OF THE INVENTION

Figure 2:
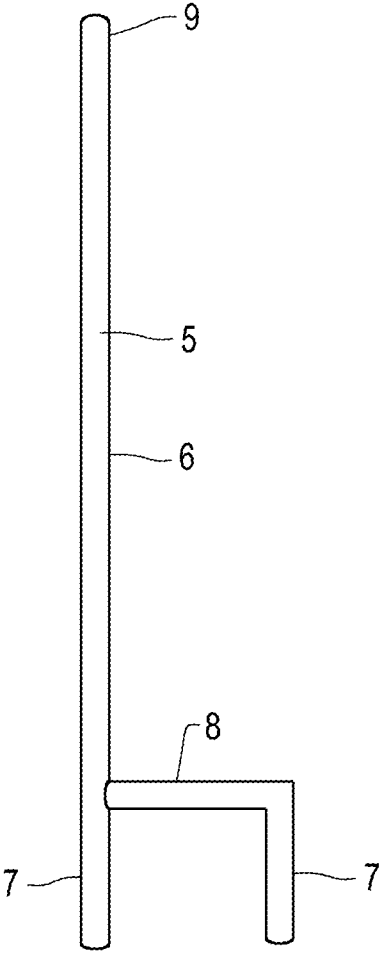
FIG. 2 is a side elevation view of a lower subassembly adapted for assembly with the upper subassembly of FIG. 1, wherein the lower subassembly includes a rod having an upper end adapted for connection with the connector of the upper subassembly and having a lower end equipped with stabilizing prongs.

The intended purpose of the following detailed description of the invention and the phraseology and terminology employed therein is to describe what is shown in the drawings, which depict and/or relate to one or more nonlimiting embodiments of the invention, and to describe certain but not all aspects of the embodiment(s) depicted in the drawings. The following detailed description also identifies certain but not all alternatives of the embodiment(s) depicted in the drawings. As nonlimiting examples, the invention encompasses additional or alternative embodiments in which one or more features or aspects shown and/or described as part of a particular embodiment could be eliminated, and also encompasses additional or alternative embodiments that combine two or more features or aspects shown and/or described as part of different embodiments. Therefore, the appended provisional claims, and not the detailed description, are intended to particularly point out subject matter regarded to be aspects of the invention, including certain but not necessarily all of the aspects and alternatives described in the detailed description.

To facilitate the description provided below of the embodiment(s) represented in the drawings, relative terms, including but not limited to, "proximal," "distal," "anterior," "posterior," "vertical," "horizontal," "lateral," "front," "rear," "side," "forward," "rearward," "top," "bottom," "upper," "lower," "above," "below," "right," "left," etc., may be used in reference to the orientations of rack assemblies (FIGS. 4 and 6) during their use and/or as represented in the drawings. All such relative terms are useful to describe the illustrated embodiment(s) but should not be otherwise interpreted as limiting the scope of the invention. Additionally, the drawings may disclose certain dimensions or proportions for the various components of the rack assemblies that are believed to be preferred or exemplary, but are otherwise not necessarily limitations to the scope of the invention.

Figure 1:
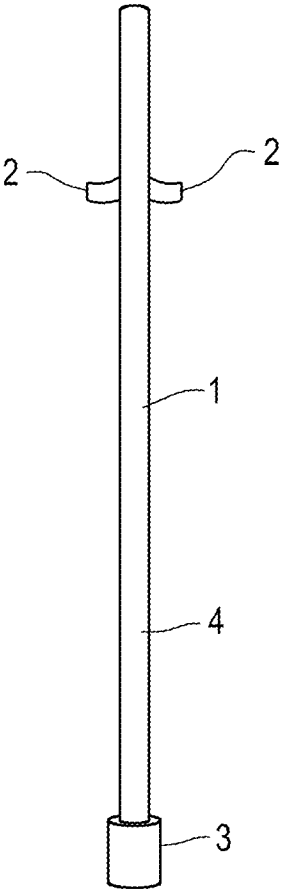
FIG. 1 is a side elevation view of an upper subassembly of a rack assembly according to a nonlimiting embodiment of the invention, wherein the upper subassembly has two small prongs from which towels may be hung or expanded, and the upper subassembly further has a connector at a lower end thereof that is adapted for connection with a lower subassembly of the rack assembly.
Figure 4:
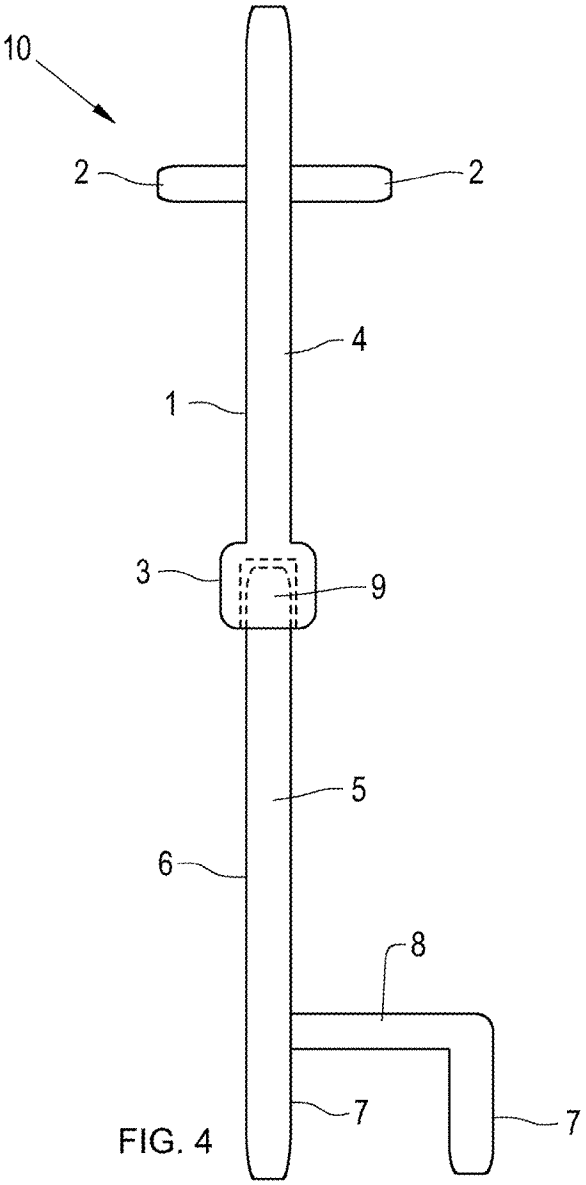
FIG. 4 represents the upper and lower subassemblies of FIGS. 1, 2, and 3 assembled to form the rack assembly.
Figure 5:
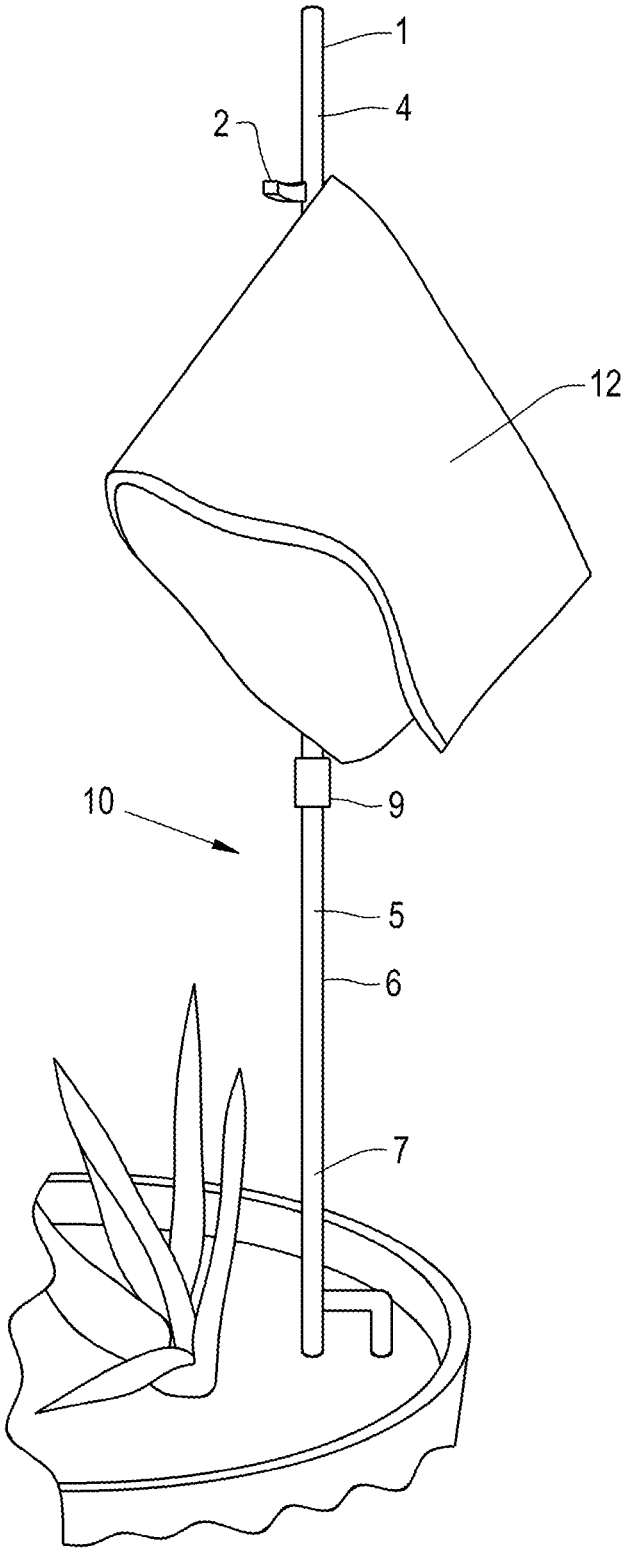
FIG. 5 is a side elevation view of the rack assembly of FIGS. 1 through 4 and illustrates an intended use of the rack assembly in which a towel hangs from one or more of the prongs of the upper subassembly.

FIG. 4 schematically represents a rack assembly 10 as comprising an upper subassembly 4 and a lower subassembly 5. The upper subassembly 4 is represented in FIG. 1 as including a rod 1 (referred to herein as an upper rod) that defines a main structure of the upper subassembly 4 and has upper and lower ends at or adjacent upper and lower ends of the upper subassembly 4. Two tabs or prongs 2 extend from an upper portion of the upper subassembly 4 such that they are capable of supporting and elevating a towel (for example, a beach towel) above and off a surface into which the rack assembly 10 has been emplaced, such as represented in FIG. 5. As evident from FIG. 1, the prongs 2 may be of limited length to promote the compactness of the rack assembly 10. Furthermore, each prong 2 is slightly curved, creating a concave upper surface that promotes the ability of a towel to be securely hung therefrom. As represented in FIG. 4, a cavity or socket 3 located at a lower end of the upper rod 1 enables connection between the lower end of the upper subassembly 4 and an upper end of the lower subassembly 5, as represented in FIG. 2.

The lower subassembly 5 is represented in FIG. 2 as including a rod 6 (referred to herein as a lower rod) that defines a main structure of the lower subassembly 5 and has upper and lower ends at or adjacent upper and lower ends of the lower subassembly 5. A stabilizing unit comprising two stabilizing legs or prongs 7 are disposed at the lower end of the rod 6. The stabilizing prongs 7 extend from a lower end or base of the rod 6 and are adapted to be emplaced in the ground, particularly sand and other loose soils, with sufficient depth to provide stability to the rack assembly 10. A first stabilizing prong 7 is shown to be coaxial with the rod 6, while a second stabilizing prong 7 is offset from the axis of the rod 6 by a horizontal beam 8 that extends from the rod 6 adjacent the base of the lower subassembly 5. The beam 8 provides a convenient means for driving the stabilizing prongs 7 into the ground by the user placing a foot on the beam 8 and using their foot to transfer their weight to the beam 8. A connector 9 located at an upper end of the lower subassembly 5 is configured to connect with the socket 3 of the upper subassembly 4, enabling the assembly of the rack assembly 10 as shown in FIG. 4. As such, the socket 3 and connector 9 serve as connecting means for the upper and lower subassemblies 4 and 5 and arrange the upper and lower rods 1 and 6 to be coaxial with each other.

Figure 3:
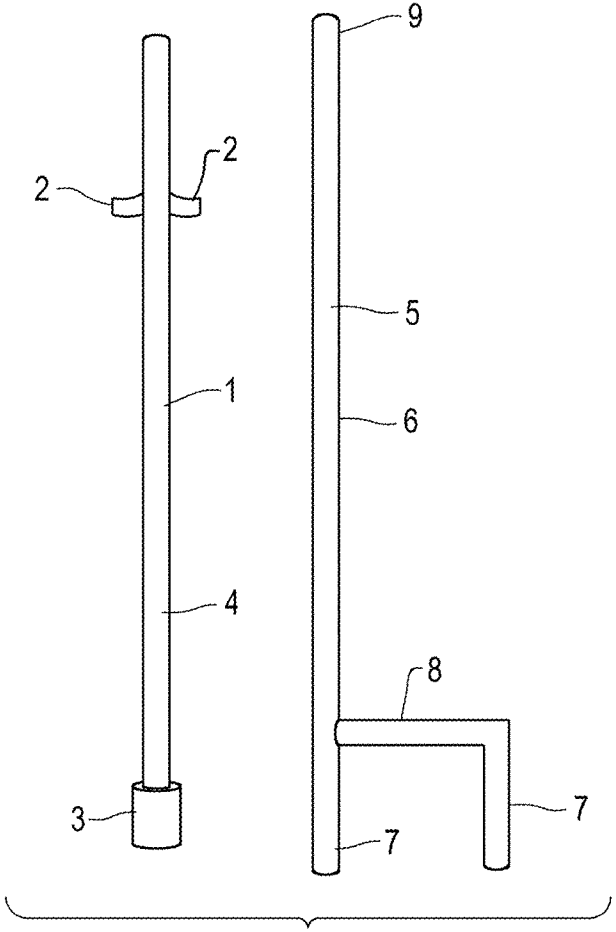
FIG. 3 is a side elevation view showing the upper and lower subassemblies of FIGS. 1 and 2, respectively.

FIG. 3 represents the upper subassembly 4 and lower subassembly 5 of the rack assembly 10 side by side and evidences that the socket 3 of the upper subassembly 4 is of sufficient width to allow the connector 9 of the lower subassembly 5 to be received within the socket 3, thus removably but securely connecting the upper subassembly 4 and lower subassembly 5 to assemble the rack assembly 10. FIG. 4 represents the placement of the connector 9 of the lower subassembly 5 within the socket 3 of the upper subassembly 4, thereby assembling the rack assembly 10. Alternative embodiments of this invention may include other or additional connecting means by which the upper subassembly 4 and lower subassembly 5 are connected, including but not limited to placing the socket 3 on the lower subassembly 5, complementary threads in the socket 3 and connector 9, clamps, or other connecting means within the knowledge of those skilled in the art.

FIG. 5 is a nonlimiting representation of a use of the rack assembly 10 of FIG. 4. The upper rod 1 of the upper subassembly 4 is connected to the rod 6 of the lower subassembly 5 as a result of the connection between the socket 3 of the upper subassembly 4 and the connector 9 of the lower subassembly 5, thereby resulting in the assemble of the rack assembly 10. A towel 12 is shown as hung from one of the prongs 2, demonstrating a nonlimiting example of a use of the rack assembly 10. The stabilizing prongs 7 are sufficiently emplaced within soil such that the rack assembly 10 is sufficiently stable to remain upright while supporting the weight of the towel 12. As evident from FIGS. 4 and 5, the rack assembly 10 is compact to promote its transportability, and yet capable of securely supporting a towel 12 above a ground surface.

FIGS. 6 through 10 schematically represent another rack assembly 20 within the scope of the invention. Similar to the rack assembly 10 of FIGS. 1 through 5, the rack assembly 20 is represented as comprising an upper subassembly 24 and a lower subassembly 25 that are assembled together to construct the rack assembly 20. The upper subassembly 24 is represented as including a rod 21 (referred to herein as an upper rod) that defines a main structure of the upper subassembly 24 and has upper and lower ends at or adjacent upper and lower ends of the upper subassembly 24. The upper rod 21 is represented in FIGS. 6 through 10 as a tube so as to have an internal passage along its entire longitudinal extent. Two arm units 22A and 22B extend laterally from the upper subassembly 24 at an upper portion thereof such that the arm units 22A and 22B are capable of supporting and elevating a towel (for example, a beach towel) above and off a surface into which the rack assembly 20 has been emplaced. Each arm unit 22A and 22B is represented as having two oppositely-extending prongs or arms 32, though fewer and more arms in arrangements different from what is shown are foreseeable. Additionally, each arm 32 is represented as having an upturned distal end, effectively forming a hook that promotes the ability of a towel to be securely hung therefrom.

Figure 6:
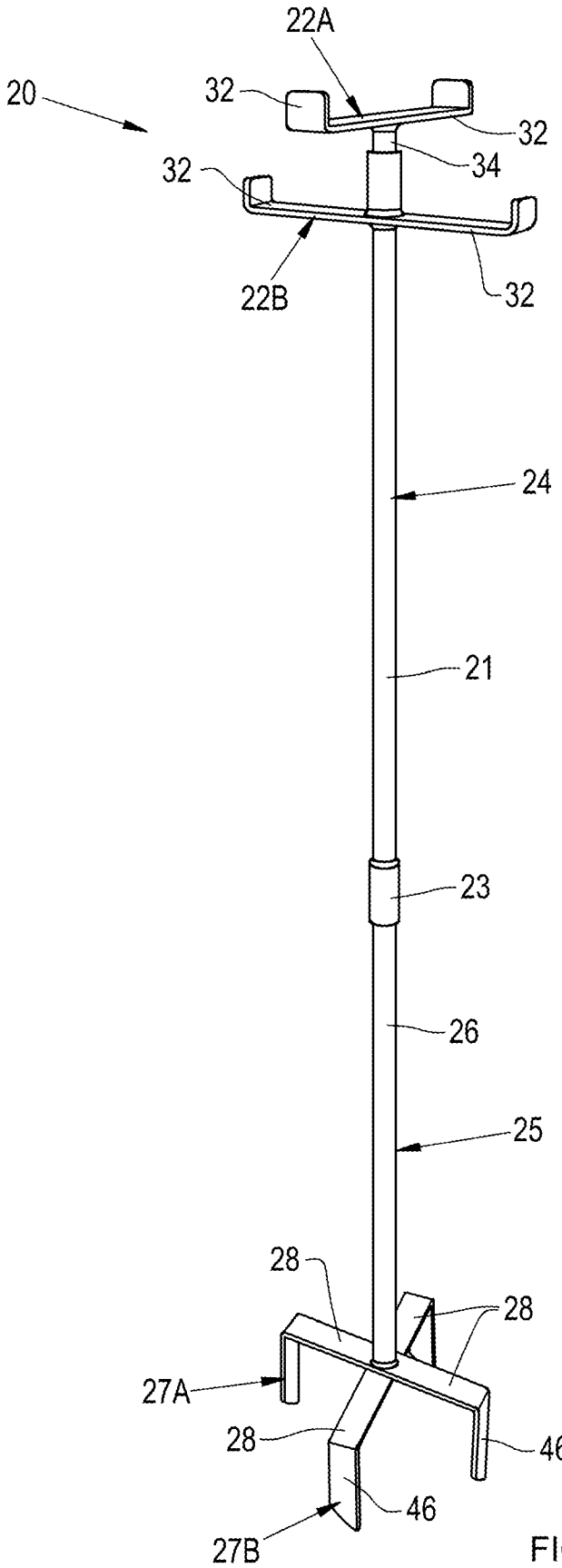
FIG. 6 represents a rack assembly according to another nonlimiting embodiment of the invention, wherein the rack assembly is constructed by assembling upper and lower subassemblies thereof.
Figure 7:
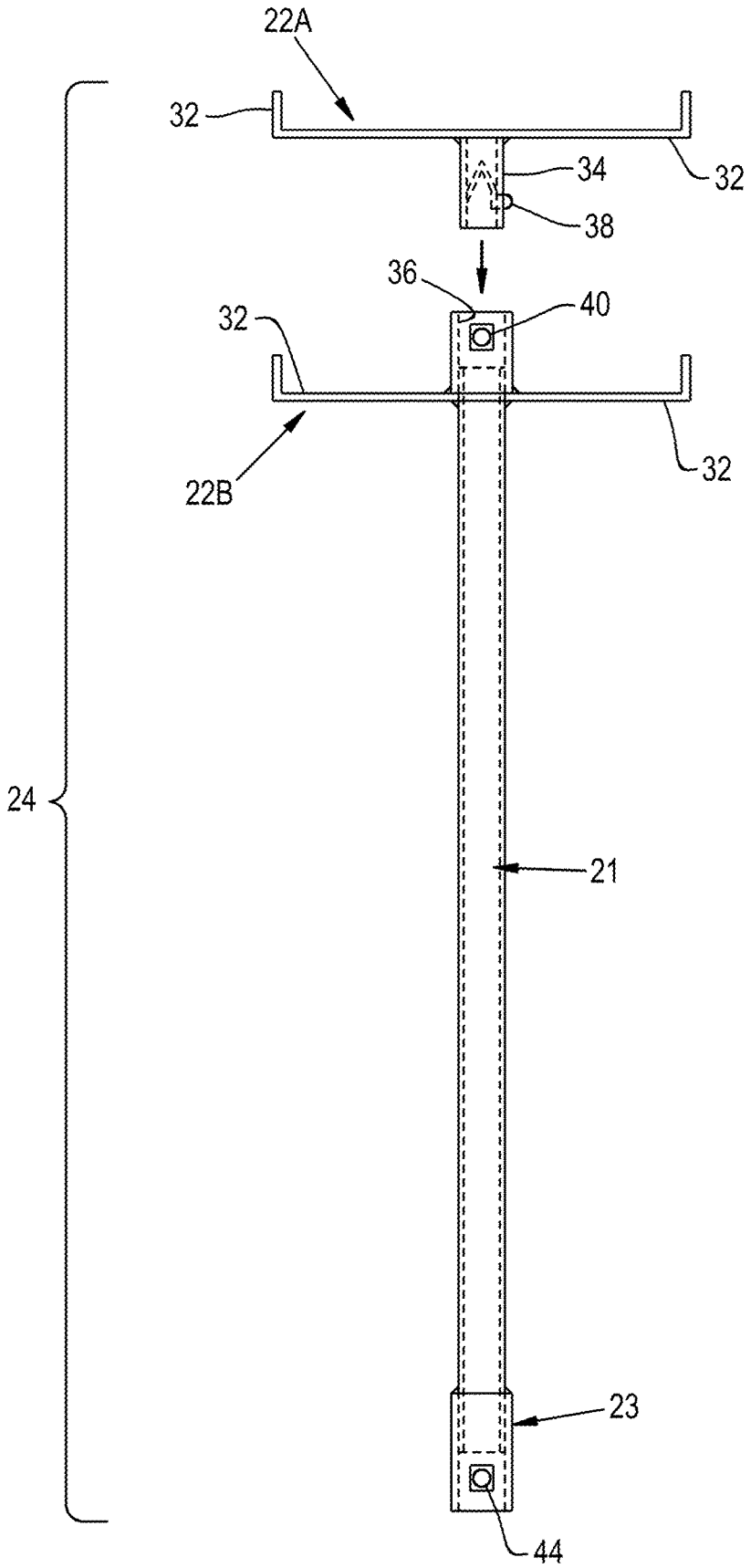
FIGS. 7 and 8 are side elevation views depicting components of the upper and lower subassemblies, respectively, of FIG. 6.
Figure 8:
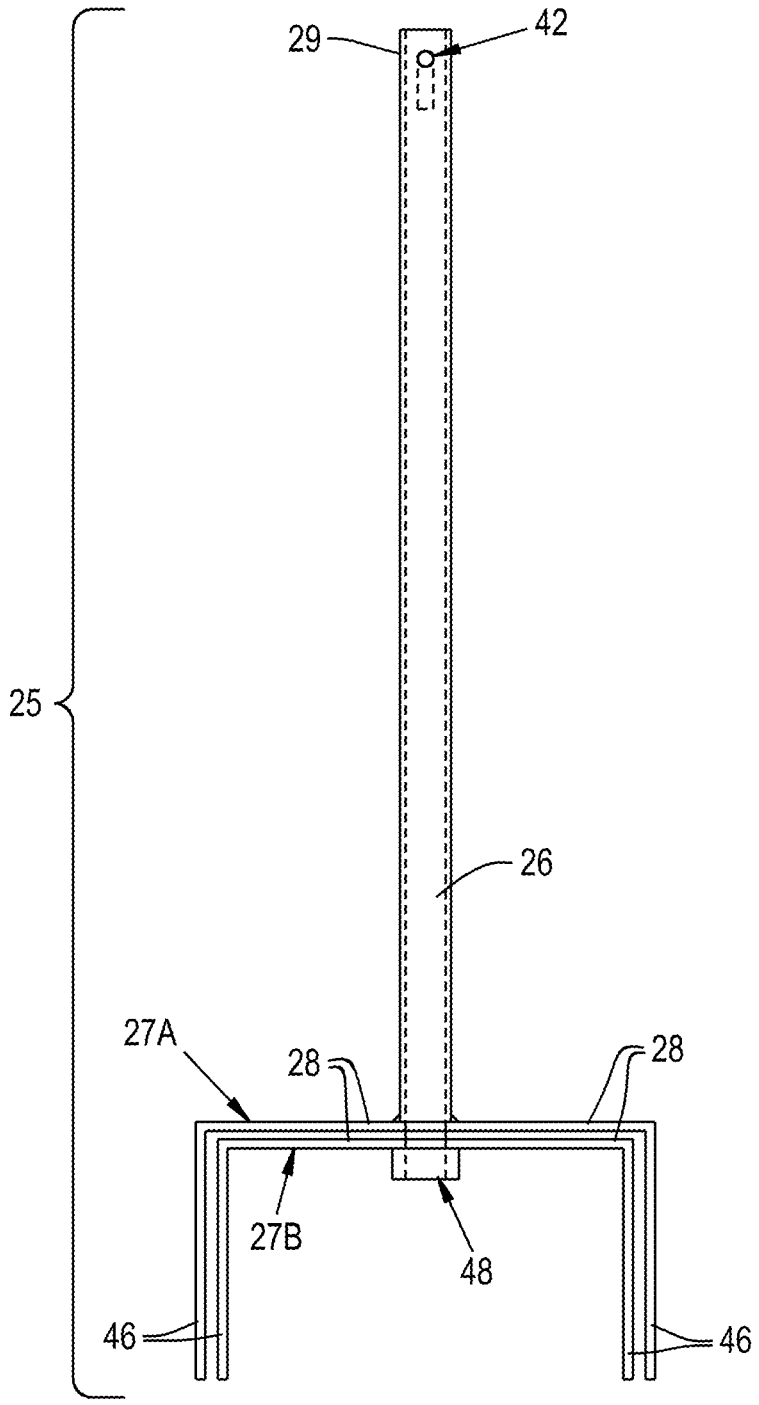
Figure 9:
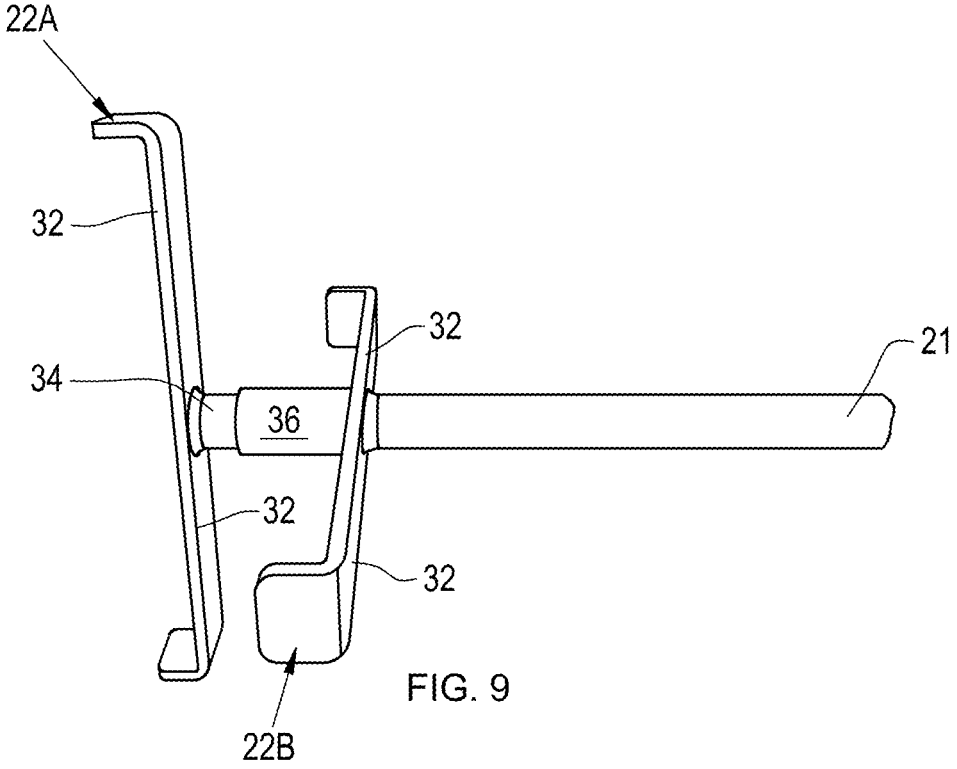
FIGS. 9 and 10 are perspective views of end portions of the upper and lower subassemblies, respectively, of FIGS. 7 and 8.
Figure 10:
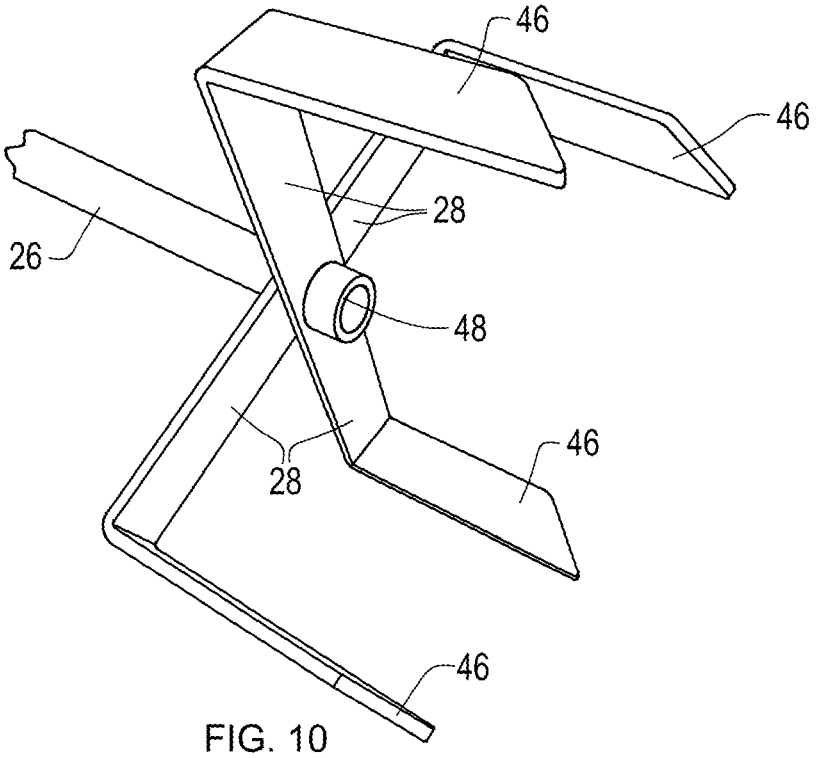

The arm unit 22A is disposed above the arm unit 22B and represented in the nonlimiting embodiment of FIG. 6 as being a separate component that is removably assembled with the upper rod 21, whereas the arm unit 22B is represented in the nonlimiting embodiment of FIG. 6 as a separate component that is permanently affixed to the upper rod 21 (such as by a metallurgical joint) though it may instead be integrally formed with the upper rod 21. The arm unit 22A comprises a central post 34 from which its arms 32 extend, and the arm unit 22B (or the upper rod 21) defines socket 36 (FIG. 7) that receives the post 34 such that the arm unit 22A is capable of being rotated relative to the remainder of the upper assembly 24. The post 34 comprises a spring pin 38 and the socket 36 comprises a complementary opening 40 that receives the pin 38 to removably secure the arm unit 22A within the socket 36 and therefore removably secure the arm unit 22A to the upper rod 21 and/or arm unit 22B such that the arm unit 22A is unable to be rotated and longitudinally translated relative to the remainder of the upper subassembly 24. Alternative embodiments may include other or additional means by which the arm unit 22A is assembled to the remainder of the upper subassembly 24, including but not limited to placing the socket 36 on the arm unit 22A and the post 34 on the upper rod 21, complementary threads in the socket 36 and on the post 34, or other means within the knowledge of those skilled in the art.

In the nonlimiting embodiment of FIGS. 6 through 10, the lower end of the upper rod 21 has a cavity or socket 23 and the upper end of the lower subassembly 25 defines a connector 29 that enables connection between the upper and lower subassemblies 24 and 25. As such, the socket 23 and connector 29 serve as connecting means for the upper and lower subassemblies 24 and 25 and arrange the upper and lower rods 21 and 26 to be coaxial with each other. Similar to the connection between the upper arm unit 22A and the remainder of the upper assembly 24, the connector 29 of the lower assembly 25 comprises a spring pin 42 and the socket 23 of the upper assembly 24 comprises a complementary opening 44 that receives the pin 42 to removably secure the upper and lower subassemblies 24 and 25 to each other. Alternative embodiments of this invention may include other or additional connecting means by which the upper subassembly 24 and lower subassembly 25 are connected, including but not limited to placing the socket 23 on the lower subassembly 25, complementary threads in the socket 23 and connector 29, clamps, or other connecting means within the knowledge of those skilled in the art.

The connector 29 of the lower subassembly 25 is represented as being located at an uppermost end of a rod 26 (referred to herein as a lower rod) that defines a main structure of the lower subassembly 25 and has upper and lower ends at or adjacent upper and lower ends of the lower subassembly 25. As with the upper rod 21 of the upper subassembly 24, the lower rod 26 of the lower subassembly 25 is represented in FIGS. 6 through 10 as a tube so as to have an internal passage along its entire longitudinal extent. Two stabilizing units 27A and 27B extend from a lower end or base of the lower rod 26 and are adapted to be emplaced in the ground, particularly sand and other loose soils, with sufficient depth to provide stability to the rack assembly 20. Each stabilizing unit 27A and 27B comprises two oppositely-extending beams 28, though fewer and more beams in arrangements different from what is shown are foreseeable. Additionally, each beam 28 is represented as having a downturned distal end, effectively forming a stabilizing leg or prong 46 that, in combination with the prongs 46 of the other stabilizing units 27A and 27B, promote the stability of the rack assembly 20 when installed in the ground. The beams 28 laterally extend from the lower rod 26 adjacent the base of the lower subassembly 25 and offset the stabilizing prongs 46 from the axis of the lower rod 26 to provide a convenient means for driving the stabilizing prongs 46 into the ground by the user placing a foot on one or more of the beams 28 and using their foot to transfer their weight to the beam(s) 28. In the embodiment shown, the beams 28 have flat upper surfaces so that, especially in the case of driving the stabilizing prongs 46 into sand, the ground material (e.g., sand) can be used to cover the flat upper surfaces of the beams 28 to additionally stabilize the rack assembly 20. The stabilizing units 27A and 27B are rotatably mounted to the base of the lower subassembly 25 and retained thereto by a collar 48, such that the units 27A and 27B are capable of rotating relative to the remainder of the lower assembly 25 and relative to each other.

The rack assembly 20 of FIGS. 6 through 10 can be utilized in essentially the same manner as represented in FIG. 5. The stabilizing prongs 27A and 27B can be rotated to be oriented relative to each, including 90 degrees to each other, before being emplaced within soil such that the rack assembly 20 is sufficiently stable to remain upright while supporting the weight of the rack assembly 20 as well as one or more articles placed thereon. As evident from FIGS. 6 through 10, the arm unit 22A can be removed and the stabilizing units 27A and 27B can be rotated so that their beams 28 are aligned and parallel with the arms 32 of the arm unit 22B and the stabilizing unit 27B is nested beneath the stabilizing unit 27A, thereby increasing the compactness and transportability of the rack assembly 20, and later the arm unit 22A can be re-attached and the stabilizing units 27A and 27B deployed to enable one or more articles, such as towels, apparel, or other item(s), to be secured above a surface into which the stabilizing prongs 46 have been inserted.

As previously noted above, though the foregoing detailed description describes certain aspects of one or more particular embodiments of the invention, alternatives could be adopted by one skilled in the art. For example, the rack assemblies 10 and 20 and their components could differ in appearance and construction from the embodiments described herein and shown in the drawings, functions of certain components of the rack assemblies 10 and 20 could be performed by components of different construction but capable of a similar (though not necessarily equivalent) function, and various materials could be used in the fabrication of the rack assemblies 10 and 20 and/or their components. As such, and again as was previously noted, it should be understood that the invention is not necessarily limited to any particular embodiment described herein or illustrated in the drawings.

The invention claimed is:

1. A rack assembly for supporting an item above a ground surface, the rack assembly comprising:

an upper subassembly comprising an upper rod having an upper end and a lower end and at least four arms extending laterally from an axis of the upper rod at the upper end of the upper rod, the upper end of the upper rod defining a socket, at least two arms of the at least four arms defining a first arm unit and at least two arms of the at least four arms defining a second arm unit, the first arm unit being rotatable relative to and removable from the upper end of the upper rod, the second arm unit being permanently affixed to the upper end of the upper rod, the first arm unit comprising a central post from which the at least two arms of the first arm unit radially extend, the central post of the first arm unit being receivable in the socket at the upper end of the upper rod such that the first arm unit is removable from the upper end of the upper rod and is rotatable relative to the second arm unit and the upper rod, each of the at least two arms of the first arm unit having an upturned distal end to define at least two hooks that extend axially away from the upper end of the upper rod and terminate axially beyond the upper end of the upper rod;

a lower subassembly removably connectable to the upper subassembly, the lower subassembly comprising a lower rod having an upper end and a lower end, at least four stabilizing prongs at the lower end of the lower rod, and at least four beams that laterally extend from the lower rod adjacent the lower end thereof and offset the at least four stabilizing prongs from an axis of the lower rod, at least two beams of the at least four beams and at least two stabilizing prongs of the at least four stabilizing prongs defining a first stabilizing unit and at least two beams of the at least four beams and at least two stabilizing prongs of the at least four stabilizing prongs defining a second stabilizing unit, the first and second stabilizing units each being rotatable relative to each other and relative to the lower rod about the axis of the lower rod so that a first beam of the at least two beams of the first stabilizing unit and a first beam of the at least two beams of the second stabilizing unit are each alignable to be parallel with a first arm of the at least two arms of the second arm unit, a second beam of the at least two beams of the first stabilizing unit and a second beam of the at least two beams of the second stabilizing unit are each alignable to be parallel with a second arm of the at least two arms of the second arm unit, the at least two beams of the second stabilizing unit are each nested axially beneath the at least two beams of the first stabilizing unit, and the at least two stabilizing prongs of the second stabilizing unit are each nested radially within the at least two stabilizing prongs of the first stabilizing unit; and means for removably connecting the lower end of the upper rod to the upper end of the lower rod to arrange the upper and lower rods coaxial with each other.

2. A method of using the rack assembly of claim 1, the method comprising:

removably connecting the lower end of the upper rod to the upper end of the lower rod to arrange the upper and lower rods coaxial with each other;

using at least one of the at least four beams to drive the at least four stabilizing prongs into the ground so that the rack assembly is in an upright position; and placing an article on the at least one of the at least four arms such that the article is elevated above and off the ground surface.

3. The method of claim 2, wherein the ground is sand and the at least four beams have flat upper surfaces, the method further comprising covering the flat upper surfaces of the at least four beams with the sand.

4. The method of claim 2, further comprising:

removing the at least four stabilizing prongs from the ground;

removing the first arm unit from the upper end of the lower rod; and rotating the first and second stabilizing units so that the at least four beams thereof are aligned and parallel with the at least two arms of the second arm unit and the second stabilizing unit is nested beneath the first stabilizing unit.

* * * * *